US010668989B2

(12) United States Patent
Hellesmark

(10) Patent No.: US 10,668,989 B2
(45) Date of Patent: Jun. 2, 2020

(54) METHODS AND SYSTEM RELATING TO POSITIONING A SHIP TO SIDE-BY-SIDE CONFIGURATION ALONGSIDE A FLOATING OFFSHORE STORAGE FACILITY AND TRANSFERRING FLUID CARGO THEREBETWEEN

(71) Applicant: HiLoad LNG AS, Arendal (NO)

(72) Inventor: Svein Børge Hellesmark, Fevik (NO)

(73) Assignee: HiLoad LNG AS, Arendal (NO)

( * ) Notice: Subject to any disclaimer, the term of this patent is extended or adjusted under 35 U.S.C. 154(b) by 113 days.

(21) Appl. No.: 15/825,185

(22) Filed: Nov. 29, 2017

(65) Prior Publication Data

US 2018/0148135 A1 May 31, 2018

Related U.S. Application Data

(60) Provisional application No. 62/427,474, filed on Nov. 29, 2016.

(51) Int. Cl.

| | |
|---|---|
| ***B63B 35/70*** | (2006.01) |
| ***B63B 21/56*** | (2006.01) |
| ***B63B 17/00*** | (2006.01) |
| *B63B 27/34* | (2006.01) |
| *B63B 35/44* | (2006.01) |

(52) U.S. Cl.

CPC ..... *B63B 21/56* (2013.01); *B63B 17/0027* (2013.01); *B63B 35/70* (2013.01); *B63B 27/34* (2013.01); *B63B 2035/4486* (2013.01)

(58) Field of Classification Search

CPC ..... B63B 21/56; B63B 27/34; B63B 35/70

See application file for complete search history.

(56) References Cited

U.S. PATENT DOCUMENTS

| | | | | |
|---|---|---|---|---|
| 6,848,382 | B1 * | 2/2005 | Bekker | B63H 20/00 114/144 B |
| 8,186,170 | B2 * | 5/2012 | Boatman | B63B 21/50 114/230.12 |
| 9,731,795 | B2 * | 8/2017 | Deletre | B63B 27/24 |
| 9,902,471 | B2 * | 2/2018 | Hellesmark | B63B 27/25 |
| 2012/0317996 | A1 * | 12/2012 | Lee | B63B 27/34 62/50.1 |

(Continued)

*Primary Examiner* — S. Joseph Morano

*Assistant Examiner* — Jovon E Hayes

(74) *Attorney, Agent, or Firm* — Cesari and McKenna, LLP

(57) ABSTRACT

A method is for performing an approach to position a ship in side-by-side configuration alongside a floating offshore storage facility, for transfer of fluid cargo between the floating offshore storage facility and the ship. The method may comprise connecting a helper vessel to the ship, moving the ship on an approach path toward the floating offshore storage facility using the helper vessel, and obtaining a component of sideways movement of the ship by applying thrust from the connected helper vessel, to facilitate moving the ship on the approach path and position the ship in the side-by-side configuration. The ship can be brought into the side-by-side configuration alongside the floating offshore storage facility, at least one transfer pipe can be connected between the ship and the floating offshore storage facility, and communication can be opened through the transfer pipe to communicate fluid cargo between the ship and the storage facility.

19 Claims, 7 Drawing Sheets

(56) References Cited

U.S. PATENT DOCUMENTS

| | | | | |
|---|---|---|---|---|
| 2016/0009353 | A1* | 1/2016 | Cooper | B63B 21/507<br>701/21 |
| 2018/0148135 | A1* | 5/2018 | Hellesmark | B63B 21/56 |

* cited by examiner

METHODS AND SYSTEM RELATING TO POSITIONING A SHIP TO SIDE-BY-SIDE CONFIGURATION ALONGSIDE A FLOATING OFFSHORE STORAGE FACILITY AND TRANSFERRING FLUID CARGO THEREBETWEEN

CROSS-REFERENCE TO RELATED APPLICATIONS

This application claims the benefit of and priority from Provisional U.S. Patent Application No. 62/427,474, filed Nov. 29, 2016 and is incorporated herein by reference, in entirety.

TECHNICAL FIELD

The present invention relates in particular to the transfer of fluid cargo offshore, and the positioning of a ship in side-by-side configuration alongside a floating offshore storage facility for the transfer of fluid cargo.

BACKGROUND

Transferring cargo off or onto a vessel at sea can be challenging, not least in difficult weather and wave conditions. In a typical scenario, cargo may be stored on an offshore storage facility which may be long-term moored in a selected location offshore. From time to time, the storage facility may receive visits from a ship. The cargo may then be transferred from the storage facility and loaded onto the ship. The ship may then depart and transport the cargo to another destination, e.g. a receiving facility onshore or the like. The offshore storage facility may itself be a floating vessel in the form of a ship. It may for instance be spread moored in a fixed orientation, or may be turret moored so that it may rotate and "weathervane" about a mooring point into an equilibrium orientation in response to forces imparted by waves and/or wind. The storage facility may be later replenished with new cargo to replace that which has been loaded onto the visiting ship. In order to transfer the cargo between the storage facility and the ship, it is normally sought to bring the ship alongside the storage facility into a suitable location so that cargo can pass between them using loading/offloading equipment. To this end, various mooring and loading systems are known.

In particular, side-by-Side (SBS) loading systems are well known in the oil and gas industry. Such systems are typically used for loading cargo in the form of fluid or gas, such as liquefied petroleum gas (LPG) or liquefied natural gas (LNG) from a turret moored or spread moored floating production storage and offloading (FPSO) or floating liquefied natural gas (FLNG) facility (ship-shaped floating installation). The SBS system can be characterized by a visiting ship, e.g. a crude oil tanker, LPG carrier or LNG carrier that is moored alongside the floating installation by use of soft fenders and mooring lines between the units. In order to bring the ship alongside the floating installation, tugs are typically used. It is for example common for 3 or 4 tugs to be used for the mooring operation. Once moored, a fluid transfer system between the two vessels may then be connected. The fluid transfer system may typically use loading arms or hoses which may allow some movement between the vessels during the transfer operation. Typically, the transfer operation may take place over a period of around 24 hours.

The mooring operation using tugs can have limitations and challenges, and may suffer particularly in difficult wave, wind, and current conditions. In order to position and moor a visiting ship, e.g. an LNG carrier (LNGC), tugs may push against a side of the ship to urge the ship toward the mooring position alongside the storage facility, while the ship may typically have a heading toward the oncoming waves. In order to push the ship sideways, the tugs (operating in "push mode") may generally be oriented beam on to the waves and this can result in significant roll motions of the push tugs. Large forces may be generated between the tug and the side of the ship due to the tug motions in waves. In addition, the bollard pull efficiency of the tugs when operating in high waves is reduced due to propeller "ventilation". Thruster wake from tugs may also hit the side of the ship leading to additionally reduced thruster efficiency. As a result, the typical maximum wave height during berthing of an LNGC vessel can be Hs 2.0-2.5 m (significant wave height) or significantly less depending on the wave periods (long period swell can in particular reduce the operational limit).

There are now means of reducing the roll motion of LNG carriers. However, if the ship is rolling, high mooring line loads can be imparted, and slosh damage may occur in the tank (membrane) containment system of the LNG carrier when partially filled.

It can be appreciated that some hazardous kinds of fluid cargo such as LNG or LPG can present a fire or explosion risk. In the event of an emergency during transfer, it may be necessary to remove the ship quickly from the storage facility. In an emergency escape situation of this kind, e.g. if an explosion or fire occurs, typically two tugs will be used to pull the LNGC safely away from the FLNG, requiring mooring lines from the tugs to be connected, and release of the ship from the storage facility. These operations can be time consuming and inconvenient, and they may form operation critical elements of the system. Thus, there may be requirements for several tugs to be located nearby and potentially be engaged if required during the transfer process, which can be inconvenient. In difficult weather, it can be a challenge to even utilize tugs at all in the mooring and disconnect/emergency activities mentioned above.

SUMMARY

There can be a need for systems and methods through which side-by-side transfer of cargo can take place offshore and one or more of the issues mentioned above can be addressed.

According to a first aspect of the invention, there is provided a method of performing an approach to position a ship in side-by-side configuration alongside a floating offshore storage facility, for transfer of fluid cargo between the ship and the floating offshore storage facility, the method comprising:

- connecting a helper vessel to the ship;
- moving the ship on an approach path toward the floating offshore storage facility using the helper vessel; and
- obtaining a component of sideways movement of the ship by applying thrust from the connected helper vessel, to facilitate moving the ship on the approach path and position the ship in the side-by-side configuration.

The method may further comprise operating the helper vessel to apply thrust, so as to push or urge the ship with a component of force sideways toward and/or against the floating offshore storage facility.

The helper vessel may have a keel and the helper vessel may be connected to the ship such that the keel may be arranged underneath the hull of the ship. The helper vessel may be connected to an underside of the hull of the ship through an underwater attachment system. The helper vessel may preferably be connected in fixed relationship to the ship. The helper vessel may typically be connected at midships position along the ship.

The helper vessel may comprise a dynamic positioning system, and the method may further comprise operating the helper vessel under control of the dynamic positioning system to control the movement of the ship on the approach path toward the storage facility. Through the movement of the ship on the approach path, the ship may advance laterally toward the storage facility, e.g. into position alongside the storage facility. The movement of the ship on the approach path may be obtainable solely from operating the helper vessel, e.g. by thrust applied by the helper vessel. A desired heading or orientation of the ship may be obtained from operating an engine, bow thruster, and/or aft rudder of the ship. The helper vessel may not be sufficient alone to obtain a desired heading.

The method may further comprise operating at least one rudder e.g. at an aft of the ship, to control a heading of the ship during the movement of the ship on the approach path into position in the side-by-side configuration.

The method may further comprise operating the ship, e.g. at least one propeller of the ship, in an ahead direction or in a direction having a component ahead. The method may further comprise operating the ship, e.g. at least one propeller of the ship, in a condition dead slow ahead during the movement of the ship on the approach path into position.

The method may further comprise operating the helper vessel to apply thrust to press a side of the ship against a side of the offshore storage facility when in the side-by-side configuration.

The ship may have a first, near side to be arranged adjacent to the storage facility when in the side-by-side configuration, and a second, far side. The helper vessel may be connected to the far side of the ship.

The helper vessel may comprise a HiLoad® unit. The helper vessel may have a narrow tower, which may extend upright through sea surface, and a broad submerged hull and/or keel. The centre of gravity of the helper vessel may be lower than its centre of buoyancy.

According to a second aspect of the invention, there is provided a method of transferring cargo between a ship and a floating offshore storage facility, the ship having been brought into a side-by-side configuration alongside the floating offshore storage facility by performing the method according to the first aspect, the method comprising the steps of:

- connecting a transfer pipe between the ship and the floating offshore storage facility; and
- opening communication through the transfer pipe to communicate fluid cargo between the ship and the storage facility.

The fluid cargo may comprise Liquefied Natural Gas or Liquefied Petroleum Gas.

The method may further comprise operating the helper vessel to apply thrust to urge the ship against a side of the floating offshore storage facility in the side-by-side configuration during the transfer of the fluid cargo.

The method may further comprise connecting the transfer pipe to a midships pipe manifold of the cargo ship.

The method may further comprise operating the helper vessel to facilitate maintaining the cargo ship in the side-by-side configuration without requiring mooring lines to hold the cargo ship in side-by-side configuration alongside the storage facility.

The floating storage facility may comprise a storage vessel, e.g. a ship, which is either spread moored or turret moored.

According to a third aspect of the invention, there is provided system for bringing a ship into side-by-side configuration alongside a floating offshore storage facility and transferring fluid cargo between the ship and the floating offshore storage facility, the system including:

- the offshore floating storage facility;
- the ship;
- one or more transfer pipe(s) connectable to the ship and said storage facility, for transferring fluid cargo between the cargo ship and the floating storage facility in the side-by side configuration; and
- a helper vessel configured to be connected to the cargo ship, the helper vessel comprising at least one propeller operable to apply thrust for obtaining a component of sideways movement of the ship for facilitating movement of the ship on an approach path toward the offshore floating storage facility to position the ship in the side-by-side configuration.

Any of the various aspects of the invention may include further features as described in relation to any other aspect, wherever described herein. Features described in one embodiment may be combined in other embodiments. For example, a selected feature from a first embodiment that is compatible with the arrangement in a second embodiment may be employed, e.g. as an additional, alternative or optional feature, e.g. inserted or exchanged for a similar or like feature, in the second embodiment to perform (in the second embodiment) in the same or corresponding manner as it does in the first embodiment.

Various advantages of the invention and its features are described and will be apparent from the specification throughout.

BRIEF DESCRIPTION OF DRAWINGS

There will now be described, by way of example only, embodiments of the invention with reference to the accompanying drawings, in which.

SPECIFIC DESCRIPTION OF EXAMPLE EMBODIMENTS

Figure 1:
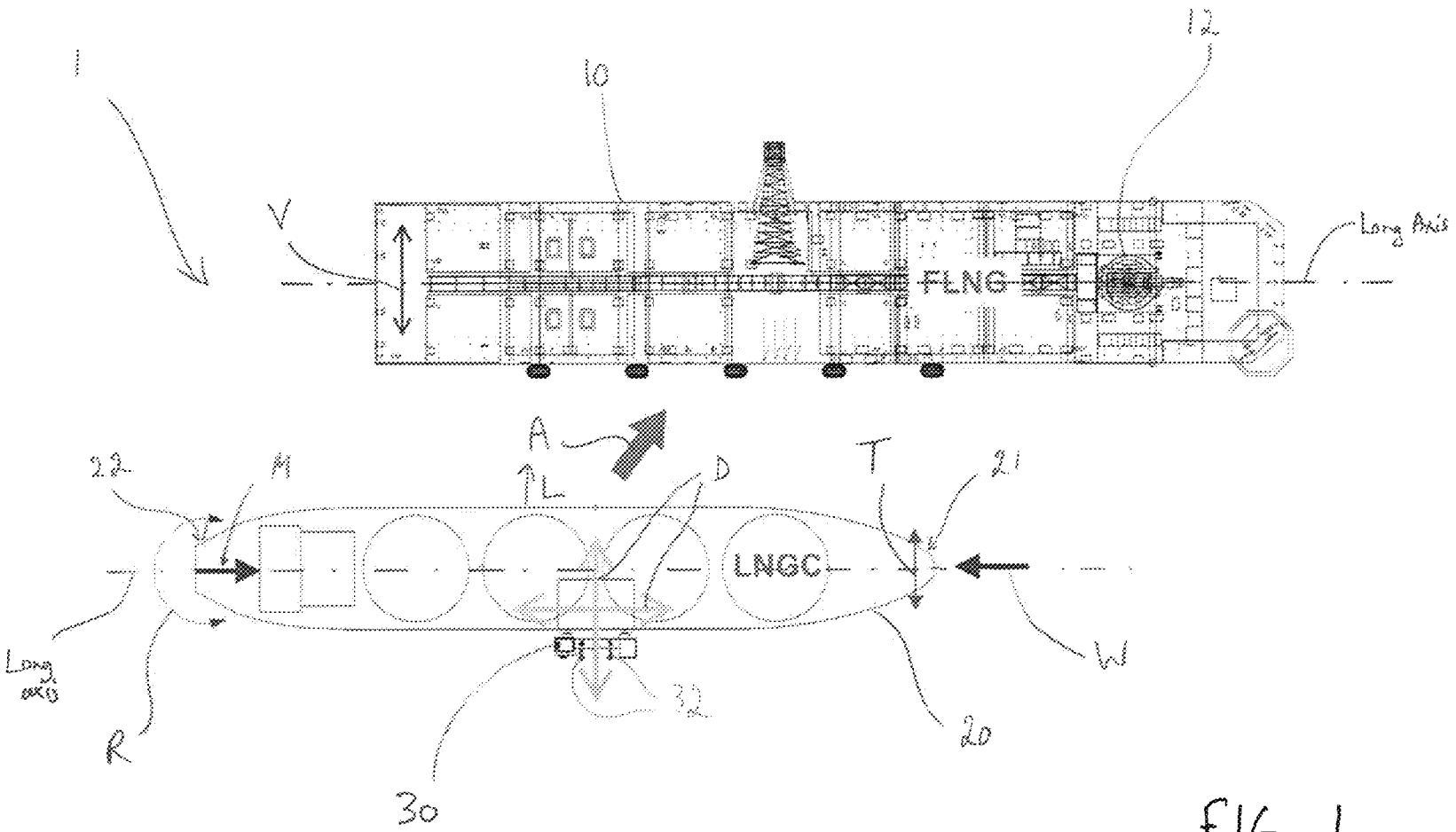
FIG. 1 is a top-view schematic representation of a system according to an embodiment of the invention where an LNG carrier is on approach for mooring to a floating LNG storage vessel.

Turning first to FIG. 1, a system 1 is generally depicted. The system 1 includes an offshore storage facility in the form of a floating LNG storage vessel 10 and a ship in the form of an LNG carrier 20. In FIG. 1, the LNG carrier 20 is on approach toward the floating LNG storage vessel 10, as indicated by arrow A.

To facilitate the approach, the system 1 includes a helper vessel 30 which is attached midships to the LNG carrier 20.

The floating LNG storage vessel 10 is moored on a long-term basis at the indicated location offshore. The storage vessel 10 has a turret 12 which comprises a rotational connection through which the storage vessel 10 is turret moored and rotatable about a vertical axis. The floating LNG storage vessel 10 can thus rotate about the rotational connection. This allows the storage vessel 10 to weathervane passively or otherwise align e.g. by active control along a desired direction. The rotational movability of the storage vessel 10 is indicated by arrow V in FIG. 1.

The wave direction of incoming waves is indicated by arrow W. The storage vessel 10 is arranged end on toward the wave direction W. Similarly, the LNG carrier 20 has a heading head on to the wave direction. That is, a bow end 21 is arranged "up weather", toward the oncoming waves. In such an orientation, rolling of the LNG carrier 20 can be minimized and speed control may be greater.

The LNG carrier 20 has main engines and propellers at the stern end 22 for propulsion of the carrier 20 as indicated by arrow M. In addition, LNG carrier 20 has a rudder at the stern end 22 for imparting a steering or turning force to the LNG carrier 20. The rudder can move in an arc for imparting a steering or turning force, as indicated by arrow R, and thereby apply heading control to the LNG carrier 20 while lateral movement and positioning control is applied by the helper vessel 30. A steering or turning force can be obtained at the stern end in other examples for example by applying differential power to multiple propellers. In addition, the LNG carrier 20 may be equipped at the bow end 21 with bow thrusters arranged to impart a lateral component of thrust to the bow region of the LNG carrier 20, if required, as indicated by arrow T.

The attached helper vessel 30 has a dynamic positioning system and propellers 32 for applying thrust and propulsion. The propellers 32 can be turned and oriented to apply thrust in any lateral direction, such as the directions indicated by arrows D. The propellers of the helper vessel 30 may thus be operated under control of the dynamic positioning system. When attached to the LNG carrier 20, the thrust produced by the helper vessel 30 is communicated to the LNG carrier 20, to impart an influencing force on the position of the LNG carrier 20.

In FIG. 1, the LNG carrier 20 is moved and brought into a side-by-side position alongside the storage vessel 10 in the following steps. The LNG carrier 20 operates with its main engines and propellers set at dead slow ahead, indicated by arrow M. The rudder is operated at the stern to impart a steering or turning force to the carrier 20 if required, as indicated by arrow R. The helper vessel 30 applies thrust with a lateral component of force L imparted to the LNG carrier which urges and moves the LNG carrier 20 with a component of movement sideways. In addition to imparting a component of sideways movement to the LNG carrier 20, the helper vessel 30 also operates to move the LNG carrier 20 with a component of forward movement. As a result, the LNG carrier 20, with the helper vessel 30 connected, is moved gradually in the direction A toward a mooring position alongside the floating storage vessel 10. As a back-up, the bow thrusters may be applied in accordance with arrows T to assist the rudders to control the heading of the LNG carrier 20.

It can be appreciated therefore that the combined operation of the helper vessel 30 and main propellers and rudder of the LNG carrier 20 can be sufficient to move the LNG carrier 20 into the side-by-side position. The heading of the LNG carrier 20 is obtained through steering or turning forces, e.g. from main propellers/rudder and/or bow thrusters applied at the ends of the LNG carrier 20. The lateral forward and/or sideward positioning of the LNG carrier 20 is obtained by way of the midships attached helper vessel 30. The dead slow ahead operation of the LNG carrier 20 can facilitate heading control of the LNG carrier 20, particularly in difficult weather and high sea states.

In practice, the positioning and proper approach speed and angle (i.e. in the direction A in FIG. 1), can be obtained under control of an auto pilot system on the LNG carrier 20. The auto pilot system may produce instructions to control the rudder, main propellers and engines, bow thrusters, and propulsion of the helper vessel 30 as necessary to obtain a desired approach speed and/or direction.

The helper vessel 30 also includes a dynamic positioning system. The dynamic positioning system can operate to obtain a desired position of the helper vessel 30 and LNG carrier 20 for moving the LNG carrier 20 in accordance with a desired approach speed and/or direction. The dynamic positioning system may also cooperate and/or communicate with the operating systems for the LNG carrier 20 propellers and rudders in the auto pilot system, to allow obtaining the desired speed and direction of movement. Once desired parameters, e.g. desired approach trajectory and speed, are specified and set, the auto pilot and dynamic positioning systems may operate autonomously such that the helper vessel 30 moves the LNG carrier 20 on the approach path and guides it into position side-by-side adjacent to the storage vessel 10.

All movement or advancement of the LNG carrier 20 along the approach path is obtained by operation of the helper vessel 30. The rudder/propeller of the LNG carrier 20 is operated only to provide a constant force forward (dead slow ahead force=40 ton). If this force is larger than the actual wave, wind, and current force acting (as a resultant force) on the LNG carrier 20, the helper vessel 30 is operated to simply "hold back" to avoid the LNG carrier 20 moving forward. The propeller/rudder of the LNG carrier 20 only helps with heading control of the LNG carrier 20, and not movement and steering to advance the LNG carrier 20 into different lateral positions. All movement of the LNG carrier 20, except for heading control, is therefore performed by the helper vessel 30. The dead slow ahead mode of the LNG carrier 20 is only used for heading control, not for positioning or approaching the storage vessel 10.

Figure 2:
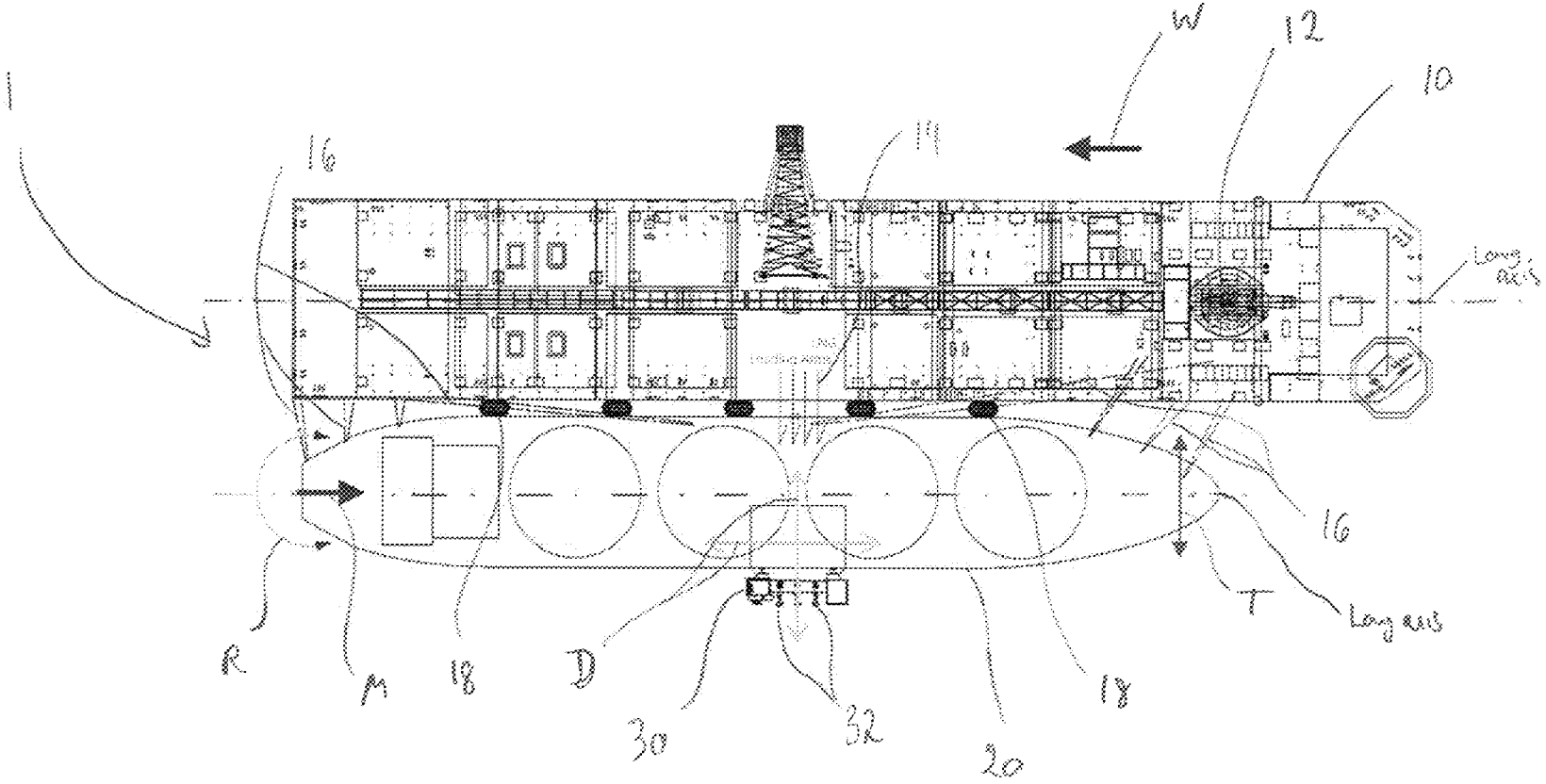
FIG. 2 is a top-view schematic representation of the system of FIG. 1 in larger scale, where the LNG carrier is moored side-by-side to the floating LNG storage vessel.

In FIG. 2, the resulting configuration of the system after completing the approach from FIG. 1 and bringing the LNG carrier 20 alongside the floating storage facility 10 (by way of the helper vessel) is indicated. As can be seen, the LNG carrier 20 is arranged in position side-by-side next to the LNG storage vessel 10.

The system 1 includes mooring lines 16 which connect the LNG carrier 20 to the floating storage vessel 10. The LNG carrier 20 bears against the side of the floating storage vessel 10 on fenders 18.

Loading arms are provided with pipes 14 which are connected between the LNG carrier 20 and the floating storage vessel 10 for communicating LNG fluid between the storage facility 10 and the LNG carrier 20. The pipes 14 are suspended above the sea surface and connect onto an aligned midship manifold for transferring LNG between tanks.

When in position adjacent to the floating storage facility 10, the following steps are performed. The helper vessel 30 is operated to apply thrust so that a sideways component of force is applied by the LNG carrier 20 to urge the LNG carrier 20 against the storage vessel 10. The mooring lines 16 are connected to hold the LNG carrier 20 in place. The loading arms are arranged to bridge across the sides of the LNG storage facility 10 and the LNG carrier 20. The pipes 14 are connected to inlet/outlet connections to the LNG tanks on respective vessel and carrier 10, 20. Communication of LNG fluid through the pipes 14 is opened up, and LNG passes between the storage vessel 10 and the LNG carrier 20, e.g. from the storage facility and loaded onto the LNG carrier 20.

During the transfer operation, i.e. when LNG fluid is being transferred from the storage vessel 10 to the LNG carrier 20, the helper vessel 30 remains attached midships to the LNG carrier. In this way, if an emergency situation were to occur, the helper vessel 30 is immediately on hand for facilitating the removal of the LNG carrier 20 away from the LNG storage facility 10 by applying thrust away from the LNG storage facility 10.

Use of the helper vessel 30 to urge the LNG carrier 20 against the side of the storage vessel 10 may also help to mitigate possible in-out movement of the LNG carrier 20 relative to the storage vessel 10. In turn, this may reduce or avoid "channel effects" produced by water flow in the sea in the small gap between the LNG carrier 20 and the storage vessel 10 (typ. 5 m) and may reduce or avoid dynamic forces which may occur between the units (also called "wedge effect") if incoming waves tend to push the bow of the LNG carrier 20 away from the storage vessel 10.

Although the above description refers to loading arms and pipes 14, only one arm and/or pipe could be employed in other examples. In some variants of the examples described above, the LNG carrier 20 has one (main) engine and/or one or more propeller(s) driven by the main engine(s). In other variants, LNG may be transferred through one or more pipes in the form of hose(s) which may be suspended between the LNG storage vessel 10 and the LNG carrier 20.

When in side-by-side configuration, with the LNG carrier 20 attached, the system 1 may pivot about the turret 12 to keep alignment with the wave direction W, as and when it changes. In the side-by-side configuration, the longitudinal axis of the hull from the bow end to the stern end of the LNG carrier 20 is parallel to that of the floating storage vessel 10.

Figure 3:
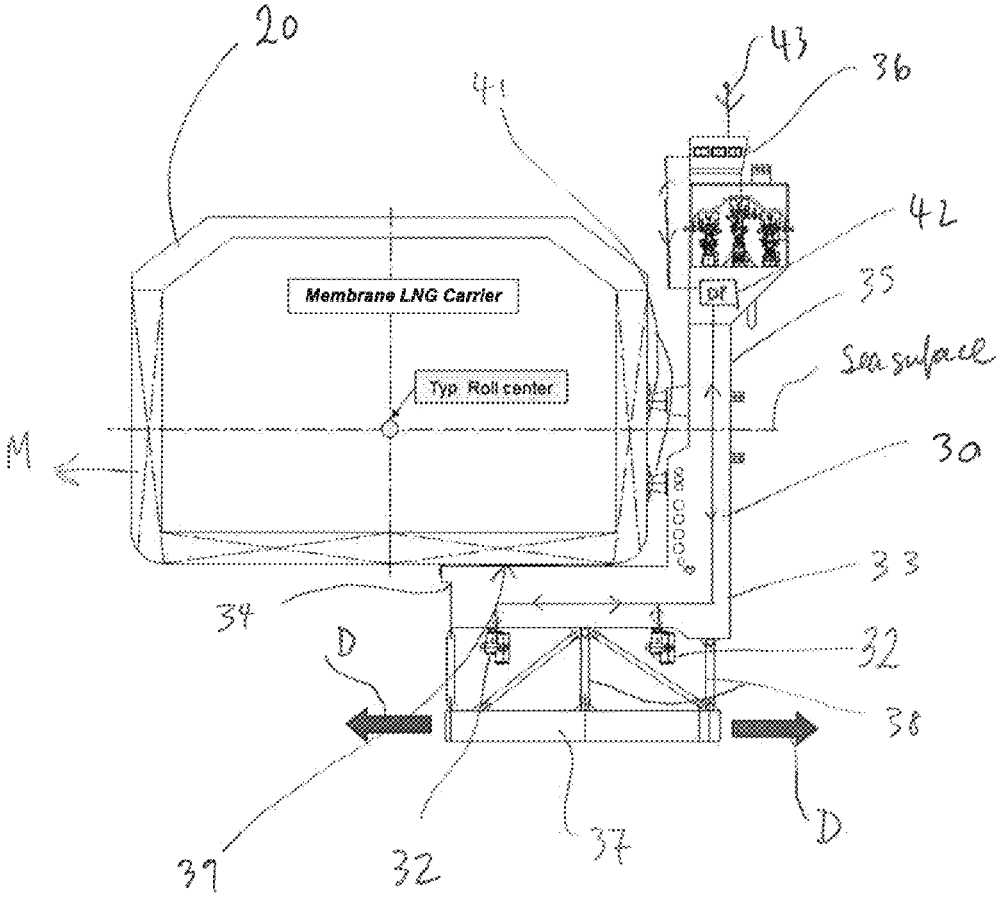
FIG. 3 is a side sectional schematic representation of the LNG carrier and a helper vessel connected to the LNG carrier of the system of FIGS. 1 and 2.

In FIG. 3, the helper vessel 30 is connected to the LNG carrier 20. The helper vessel 30 has a hull 33 and a tower 35 which extends from a submerged portion 34 of the hull upward through the sea surface. The tower 35 intersects the sea surface and is narrow compared with the submerged portion 34 of the hull, such that the helper vessel has a small area of intersection at the sea surface. Furthermore, the helper vessel 30 has a ballasted keel 37 at the bottom of the submerged portion 34 of the hull 33, mounted on supports 38. The keel 37 is positioned and ballasted to provide the helper vessel 30 with a low centre of gravity, typically below the centre of buoyancy. This can give the helper vessel 30 high stability in the water and favourable motion characteristics when operating in waves, including roll damping.

The helper vessel 30 is connected to the LNG carrier 20 as seen in FIG. 3, where the submerged portion 34 of the hull 33 is positioned so as to extend underneath the bottom of the hull of the LNG carrier 20. The ballast in the keel 37 may be adjusted to raise or lower the helper vessel 30 in the water. In this way, when it is sought to connect the helper vessel 30 to the LNG carrier 20 the vessel 30 can be lowered in the water so that the submerged portion 34 is lower than the bottom of the LNG carrier. The helper vessel 30 can then be propelled laterally to move the submerged portion 34 under the LNG carrier 20. The helper vessel 30 can then be raised slightly to bring the helper vessel 30 in contact against the underside of the hull of the LNG carrier 20. In this position, the helper vessel 30 forms an attachment to the underside of the hull of the LNG carrier 20 by means of an attachment system 39. The helper vessel 30 has fenders 41 for protecting between the helper vessel 30 and a side of the LNG carrier 20 during connection. An example helper vessel 30 which can operate in this manner is the HiLoad® unit marketed by HiLoad LNG.

The helper vessel 30 is thus connected firmly to the LNG carrier 20 by way of the attachment system 39. Thus, thrust applied through the propellers 32 of the helper vessel 30 can be communicated by way of the connection to the LNG carrier 20 to impart motion or an influencing force upon the LNG vessel 20.

By connecting to the LNG carrier 20, the helper vessel 30 in effect adds a deep keel 37 to the bottom of the LNG carrier 20 and additionally adds thrust capability, midships, under dynamic position (DP) control. The helper vessel 30 has a dynamic positioning system 42 arranged to communicate with the propulsion system including propellers 32. The DP positioning system 42 can communicate wirelessly by antenna 43 with a control system of the LNG carrier 20. Data may be transferred between them to coordinate positioning and the approach toward the LNG storage vessel according to a predetermined plan or parameters, such as velocity and direction of approach.

The helper vessel 30 is connected in fixed relationship. There is no relative motion between the helper vessel and the LNG carrier 20. The helper vessel 30 can therefore provide a practically instant bollard pull on the LNG carrier 20 in any direction, for example a pull in the range of 150 to 200 metric tons. This arrangement can facilitate the manoeuvre of the LNG carrier 20 in a controlled manner and with robust heading control assisted by the dynamic positioning.

The deep keel can facilitate stability of the LNG vessel 20 during approach to the LNG storage vessel 10 and LNG transfer, and the improved stability and/or positioning of the LNG carrier 20 by use of the helper vessel 30 may help to reduce adverse sloshing issues in membrane cargo tanks of the LNG carrier 20. More specifically, the thrusters and keel of the helper vessel 30 may facilitate reducing roll, surge, and swaying motions of the LNG carrier 20. The keel 37 may have a passive roll damping effect upon the LNG carrier 20. In the example, the bottom of the keel 17 may be 20 m or more, e.g. 28 to 30 m, e.g. 29 m, lower than the roll centre of the LNG carrier. In turn, this may reduce mooring forces, reduce motion on loading arms and hoses 14, and reduce sloshing. By way of the design of the helper vessel 30 having a deep submerged hull/keel and low centre of gravity with propellers positioned deep beneath the sea surface on a lower part of the hull, effects associated with thruster ventilation or wake as may be experienced in with prior art tugs may be avoided or reduced. Thrusters are located for instance at 18 to 20 m draught. The result can be an efficient bollard pull upon the LNG carrier 20.

Figure 4:
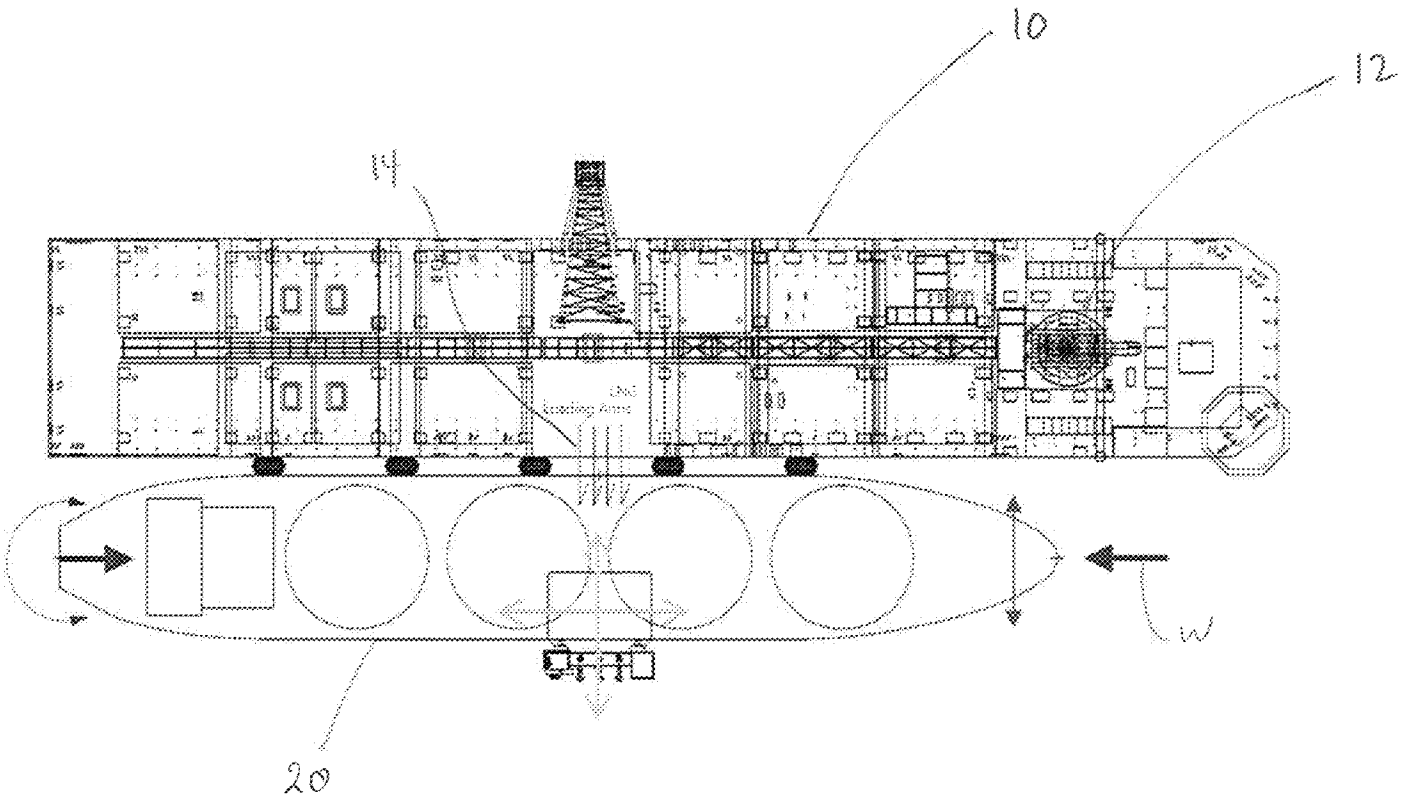
FIG. 4 is a top-view schematic representation of a system according to another embodiment where an LNG carrier is moored side-by-side to a floating LNG vessel using an attached helper vessel.

Turning now to FIG. 4, there is depicted an alternative configuration of the LNG carrier 20 during transfer of LNG from the storage vessel 10, where the LNG carrier 20 is moored and kept alongside the LNG storage vessel 10, in side-by-side position by active use of the helper vessel 10 to push the LNG carrier 20 against the side of the LNG storage vessel. The configuration is similar to that depicted in FIG. 2, during the transfer of LNG after mooring, but in this configuration of FIG. 4 no mooring lines are connected to hold the LNG carrier 20 in place.

Figure 5:
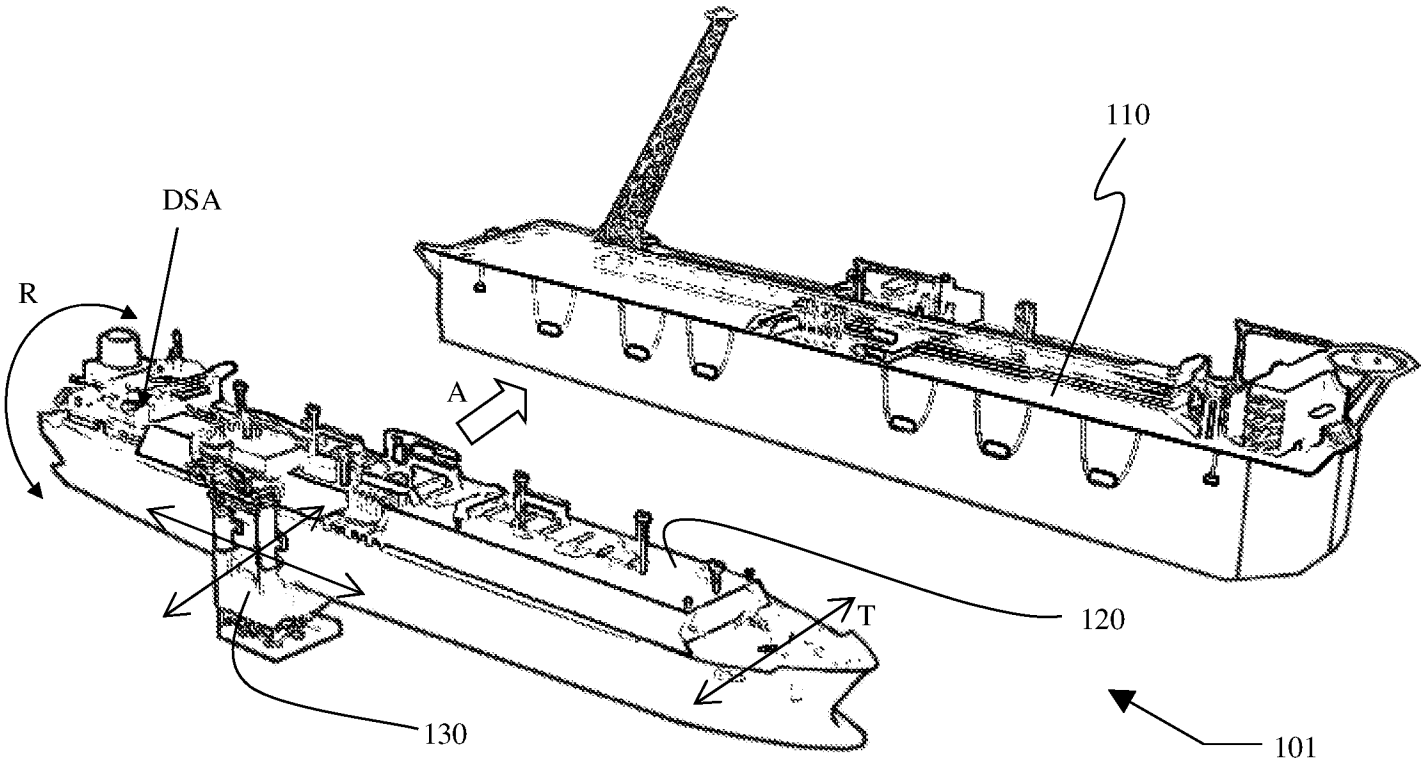
FIG. 5 is a perspective schematic representation of a system according to another embodiment where an LNG carrier is on approach for mooring to a floating LNG storage vessel (safe berthing to the FLNG, DP2 positioning of LNG carrier toward FLNG), where R represents heading control by LNGC rudder autopilot, DSA represents LNGC main engine in constant "Dead Slow Ahead" (typical foward force of 40-50 ton), and T represents LNGC Bow Thruster in back-up.
Figure 6:
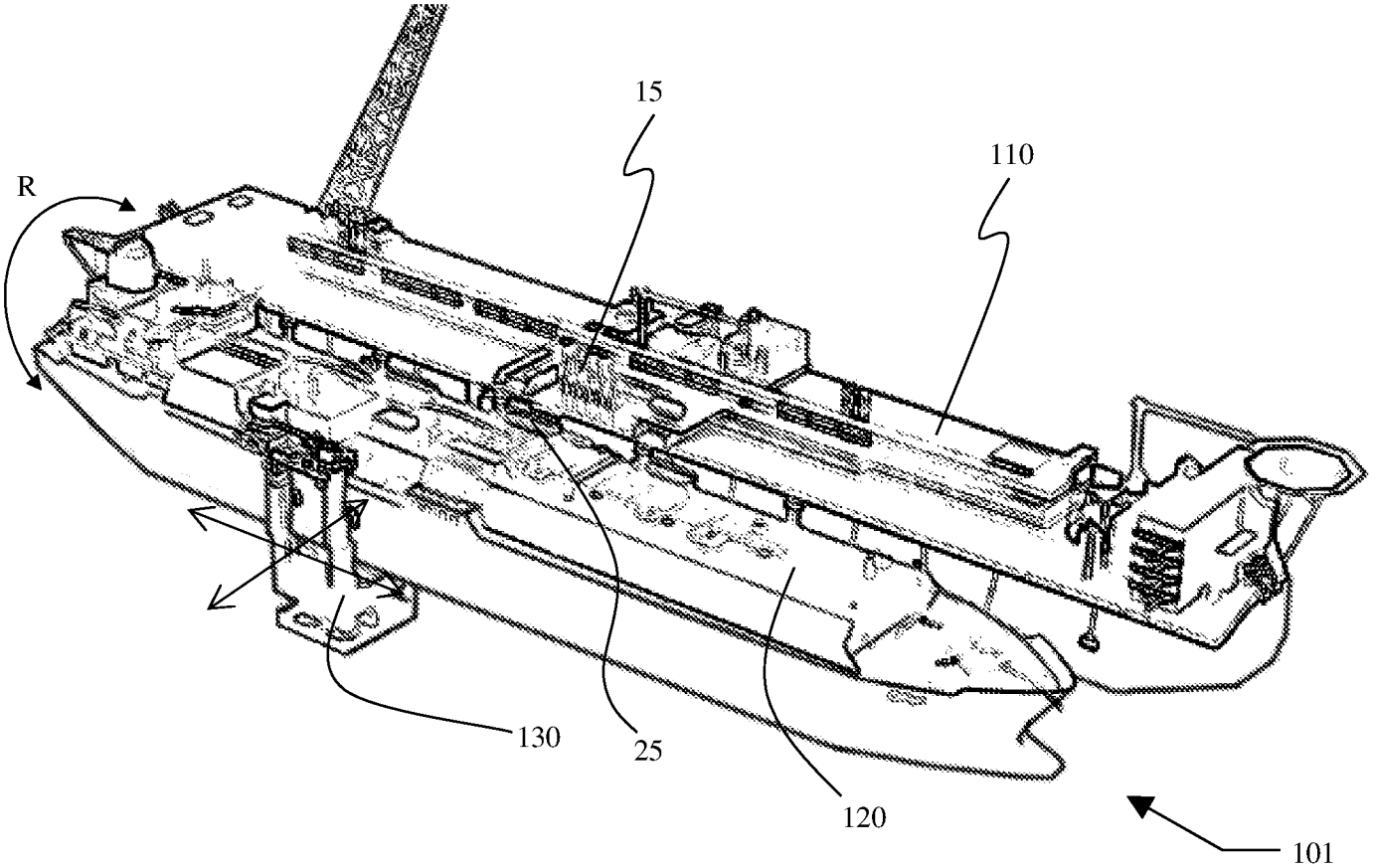
FIG. 6 is a perspective schematic representation of the system of FIG. 5 where the LNG carrier is moored side-by-side to the floating LNG storage vessel.
Figure 7:
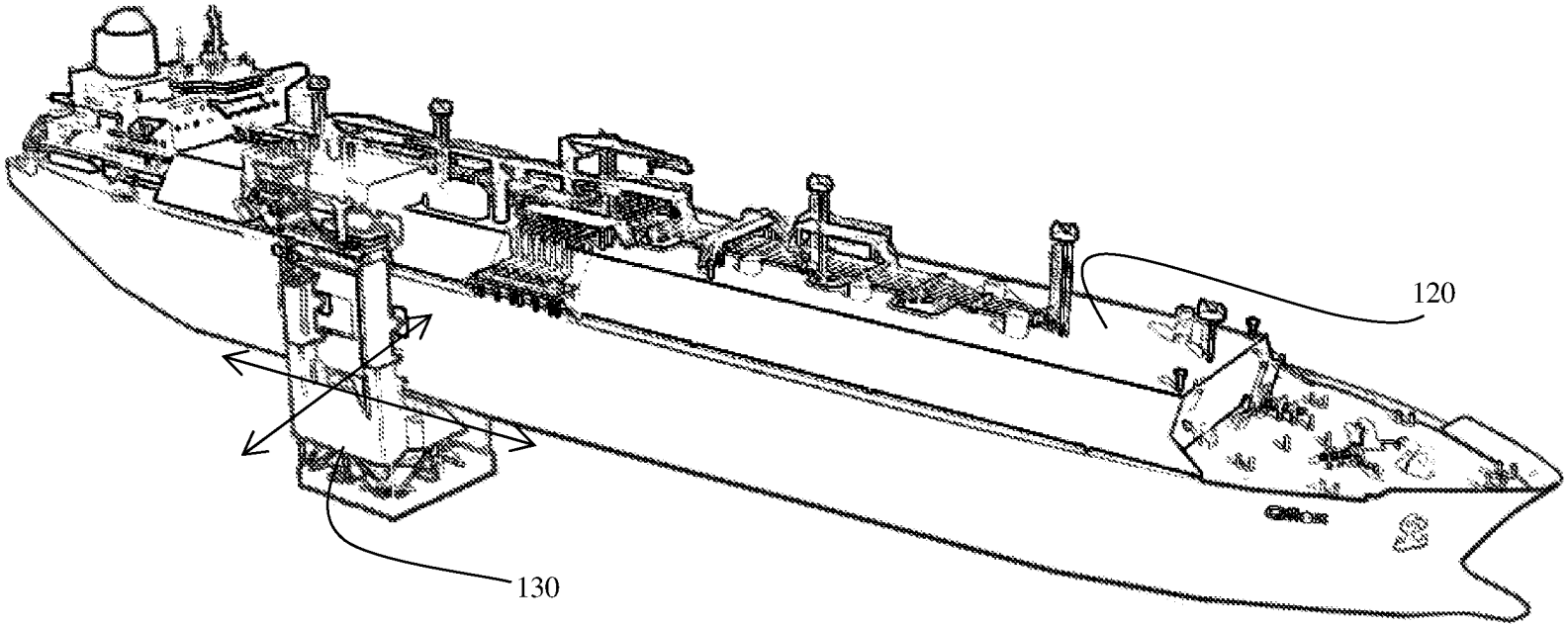
FIG. 7 is a perspective schematic representation of the LNG carrier and a helper vessel connected to the LNG carrier of the system of FIGS. 5 and 6.

FIGS. 5 to 7 exemplify a system 101 and method whereby an LNG carrier 120 is brought alongside and moored in side-by-side position relationship alongside a floating LNG storage vessel 110. A helper vessel 130 is attached to the LNG carrier 120 and is utilized to apply thrust to push or urge the LNG carrier laterally toward the mooring position alongside the storage vessel 110. When moored in the side-by-side configuration as seen in FIG. 6, the system 101 is ready for transfer of LNG to take place. Transfer hoses or loading arms are connected between aligned midship manifolds 15, 25 of the LNG storage vessel 110 and LNG carrier 120 respectively.

Although not shown in the figures described above, it can be appreciated that the helper vessel 30, 130 is attached to the LNG carrier 20, 120 when needed in order to facilitate mooring and the transfer of LNG. It may normally be stationed near the location of the LNG storage facility. When the LNG carrier 20, 120 arrives, the helper vessel 30, 130 travels to meet the LNG carrier 20, 120 at a suitable distance away from the floating LNG vessel 10, 110. This may typically be in the range of 1 to 2 nautical miles. The helper vessel 30, 130 is then attached, and operates together with the LNG carrier 20, 120 to bring the LNG carrier 20, 120 alongside the floating LNG storage vessel 10, 110 as described above.

Embodiments of the invention provide further advantages in that the approach, side-by-side mooring adjacent to the LNG storage vessel 10, and transfer of LNG can be carried out entirely without use of tugs. The helper vessel 10 can remain connected throughout and easily apply thrust for quick or instant removal and departure of the LNG carrier 10 in any direction away from the LNG storage device if required, e.g. in an emergency such as a fire or explosion risk situation. Indeed, in certain embodiments tug requirements can be reduced or tugs may not be required at all, which can simplify mooring operations and logistics and increase safety. The solution provided by the invention may also be more practical, for instance, it may be suitable in situations where it may be impractical to use tugs, such as in difficult weather (e.g. high winds, currents, and waves), also where tugs may have limitations in the length of time they can be employed. It may for instance not be practicable or possible to employ prior art tug solutions over a typical full 24-hour period during the visit of the LNG carrier 20 and transfer of LNG.

Various modifications and improvements may be made without departing from the scope of the invention herein described.

The invention claimed is:

1. A method of performing an approach to position a ship in side-by-side configuration alongside a floating offshore storage facility, for transfer of fluid cargo between the floating offshore storage facility and the ship, the method comprising:

connecting a helper vessel to the ship, the helper vessel having a keel;

moving the ship on an approach path toward the floating offshore storage facility using the helper vessel; and obtaining a component of sideways movement of the ship by applying thrust from the connected helper vessel to facilitate moving the ship on the approach path and position the ship in the side-by-side configuration, wherein the helper vessel is connected to the ship such that the keel is arranged underneath the hull of the ship.

2. A method as claimed in claim 1, which further comprises operating the helper vessel to apply thrust, so as to push or urge the ship with a component of force sideways toward and/or against the floating offshore storage facility.

3. A method as claimed in claim 1, wherein the helper vessel is connected to an underside of the hull of the ship through an underwater attachment system.

4. A method as claimed in claim 1, wherein the helper vessel is connected in a fixed relationship to the ship.

5. A method as claimed in claim 1, wherein the helper vessel comprises a dynamic positioning system, and the method further comprises operating the helper vessel under control of the dynamic positioning system to control the movement of the ship on the approach path.

6. A method as claimed in claim 1, which further comprises operating at least one rudder at an aft of the ship to control a heading of the ship during the movement of the ship on the approach path into position.

7. A method as claimed in claim 1, which further comprises operating at least one propeller of the ship in an ahead direction or in a direction having a component ahead.

8. A method as claimed in claim 1, which further comprises operating at least one propeller of the ship in a condition dead slow ahead during the movement of the ship on the approach path into position.

9. A method as claimed in claim 1, which further comprises operating the helper vessel to apply thrust to press a side of the ship against a side of the floating offshore storage facility when in the side-by-side configuration.

10. A method as claimed in claim 1, wherein the ship has a near side to be arranged adjacent to the floating offshore storage facility when in the side-by-side configuration alongside the floating offshore storage facility, and a far side, and the helper vessel is connected to the far side of the ship.

11. A method as claimed in claim 1, wherein the helper vessel has a narrow tower which extends upright through a sea surface and has a broad submerged hull.

12. A method as claimed in claim 1, wherein the center of gravity of the helper vessel is lower than its center of buoyancy.

13. A method of transferring cargo between a ship and a floating offshore storage facility, the ship having been brought into a side-by-side configuration alongside the floating offshore storage facility by performing the method as claimed in any preceding claim, the method comprising the steps of:

connecting at least one transfer pipe between the ship and the floating offshore storage facility; and opening communication through the at least one transfer pipe to communicate fluid cargo between the ship and the floating offshore storage facility.

14. A method as claimed in claim 13, wherein the fluid cargo comprises Liquefied Natural Gas or Liquefied Petroleum Gas.

15. A method as claimed in claim 13, which further comprises operating the helper vessel to apply thrust to urge the ship against a side of the floating offshore storage facility in the side-by-side configuration during the transfer of the fluid cargo.

16. A method as claimed in claim 13, which further comprises connecting the at least one transfer pipe to a midships pipe manifold of the cargo ship.

17. A method as claimed in claim 13, which further comprises operating the helper vessel to facilitate maintaining the cargo ship in the side-by-side configuration without requiring mooring lines to hold the cargo ship in side-by-side configuration alongside the floating offshore storage facility.

18. A method as claimed in claim 13, wherein the floating offshore storage facility comprises a storage ship which is either spread moored or turret moored.

19. A system for bringing a ship into side-by-side configuration alongside a floating offshore storage facility and transferring fluid cargo between the ship and the floating offshore storage facility, the system comprising:

the floating offshore storage facility;

the ship;

at least one transfer pipe connectable to the ship and the floating offshore storage facility for transferring fluid cargo between the cargo ship and the floating offshore storage facility in the side-by side configuration; and a helper vessel comprising a keel and configured to be connected to the cargo ship such that the keel is arranged underneath the hull of the ship, the helper vessel further comprising at least one propeller operable to apply thrust for obtaining a component of sideways movement of the ship for facilitating movement of the ship on an approach path toward the floating offshore storage facility to position the ship in the side-by-side configuration.

* * * * *